US010861664B2

(12) United States Patent
An et al.

(10) Patent No.: US 10,861,664 B2
(45) Date of Patent: Dec. 8, 2020

(54) ACTUATOR FOR HIGH-SPEED SWITCH

(71) Applicant: HYOSUNG HEAVY INDUSTRIES CORPORATION, Seoul (KR)

(72) Inventors: Hyun Mo An, Busan (KR); Hui Dong Hwang, Changwon-si (KR); Dong Joon Sim, Anyang-si (KR)

(73) Assignee: HYOSUNG HEAVY INDUSTRIES CORPORATION, Seoul (KR)

( * ) Notice: Subject to any disclaimer, the term of this patent is extended or adjusted under 35 U.S.C. 154(b) by 232 days.

(21) Appl. No.: 16/067,422

(22) PCT Filed: Dec. 21, 2016

(86) PCT No.: PCT/KR2016/015065
§ 371 (c)(1),
(2) Date: Jun. 29, 2018

(87) PCT Pub. No.: WO2017/116069
PCT Pub. Date: Jul. 6, 2017

(65) Prior Publication Data

US 2019/0027332 A1 Jan. 24, 2019

(30) Foreign Application Priority Data

Dec. 30, 2015 (KR) ..... 10-2015-0190341

(51) Int. Cl.
*H01H 77/00* (2006.01)
*H01H 50/30* (2006.01)
(Continued)

(52) U.S. Cl.
CPC ..... *H01H 50/30* (2013.01); *H01H 33/285* (2013.01); *H01H 33/38* (2013.01);
(Continued)

(58) Field of Classification Search
CPC ..... H01H 50/04; H01H 50/22; H01H 50/30; H01H 50/32; H01H 50/44; H01H 50/64; H01H 50/641
(Continued)

(56) References Cited

U.S. PATENT DOCUMENTS 2,540,185 A * 2/1951 Brown ..... H01H 51/065 335/156
3,153,124 A * 10/1964 Bury ..... B29C 35/16 335/186
(Continued)

FOREIGN PATENT DOCUMENTS

JP 2002-033034 A 1/2002
JP 2003-031087 A 1/2003
(Continued)

*Primary Examiner* — Shawki S Ismail
*Assistant Examiner* — Lisa N Homza
(74) *Attorney, Agent, or Firm* — Novick, Kim & Lee, PLLC; Jae Youn Kim

(57) ABSTRACT

An actuator for a high-speed switch is proposed. The actuator can include a frame having multiple mounting plates and columns. The mounting plates have parts installed thereon or movably supported thereby. The columns maintain the space between the mounting plates. A permanent magnet is installed on one of the mounting plates so as to face the second driving plate, and an elastic member is installed on the mounting plate that faces the mounting plate having the permanent magnet installed thereon, so as to provide force for the movement of the second driving plate.

6 Claims, 5 Drawing Sheets

(51) Int. Cl.

| | |
|---|---|
| ***H01H 33/28*** | (2006.01) |
| ***H01H 33/38*** | (2006.01) |
| ***H01H 50/04*** | (2006.01) |
| ***H01H 50/22*** | (2006.01) |
| *H01H 71/24* | (2006.01) |
| *H01H 73/36* | (2006.01) |
| *H01H 71/32* | (2006.01) |
| *H01H 3/60* | (2006.01) |
| *H01H 33/666* | (2006.01) |
| *H01H 3/28* | (2006.01) |
| *H01H 33/59* | (2006.01) |
| *H01H 50/32* | (2006.01) |
| *H01H 50/36* | (2006.01) |
| *H01H 50/44* | (2006.01) |
| *H01H 50/64* | (2006.01) |

(52) U.S. Cl.
CPC ..... *H01H 50/04* (2013.01); *H01H 50/22* (2013.01); *H01H 3/28* (2013.01); *H01H 3/60* (2013.01); *H01H 33/596* (2013.01); *H01H 33/6662* (2013.01); *H01H 50/32* (2013.01); *H01H 50/36* (2013.01); *H01H 50/44* (2013.01); *H01H 50/641* (2013.01); *H01H 71/24* (2013.01); *H01H 71/32* (2013.01); *H01H 73/36* (2013.01); *H01H 2050/446* (2013.01)

(58) Field of Classification Search
USPC ..... 335/156
See application file for complete search history.

(56) References Cited

U.S. PATENT DOCUMENTS 3,407,369 A * 10/1968 Hardesty ..... F23N 5/105 335/156
3,534,304 A * 10/1970 Robinson ..... H01H 77/10 335/16
3,621,419 A * 11/1971 Adams ..... H01H 51/2272 335/230
3,968,470 A * 7/1976 Brown ..... H01H 51/2281 335/230
4,064,471 A * 12/1977 Schuessler ..... H01H 51/2281 335/229
4,092,620 A * 5/1978 Schuessler ..... H01H 50/24 200/244
4,160,965 A * 7/1979 Kobler ..... H01H 51/2272 335/230
4,286,244 A * 8/1981 Schuessler ..... H01H 51/2281 335/230
4,551,698 A * 11/1985 Aidn ..... H01H 51/2272 335/78
4,703,293 A * 10/1987 Ono ..... H01H 51/229 335/80
4,797,645 A * 1/1989 Uetsuhara ..... H01F 7/1646 335/230
5,805,039 A * 9/1998 Smith ..... H01H 50/24 335/78
6,407,654 B1 * 6/2002 Saito ..... H01H 51/229 335/80
6,411,184 B1 * 6/2002 Comtois ..... H01H 50/045 335/106
6,670,871 B1 * 12/2003 Saso ..... H01H 51/2272 335/128
6,831,535 B1 * 12/2004 Wen ..... H01H 51/2209 335/132
6,960,847 B2 * 11/2005 Suzuki ..... H01F 7/1615 310/13
7,015,778 B2 * 3/2006 Fukushima ..... G02B 6/3572 335/128
2011/0181382 A1 * 7/2011 Eum ..... H01H 50/546 335/156
2013/0057369 A1 * 3/2013 Yano ..... H01H 9/443 335/156
2014/0354381 A1 * 12/2014 Kohlhafer ..... H01H 50/20 335/179
2015/0371748 A1 12/2015 Kim
2017/0345595 A1 * 11/2017 Lang ..... H01H 71/322

FOREIGN PATENT DOCUMENTS

| | | | |
|---|---|---|---|
| JP | 2010-262840 | A | 11/2010 |
| KR | 10-2012-0131509 | A | 12/2012 |
| KR | 10-1266043 | B1 | 5/2013 |
| KR | 10-2014-0108048 | A | 9/2014 |
| KR | 10-1444729 | B1 | 9/2014 |
| WO | 2015/129115 | A1 | 9/2015 |

* cited by examiner

ACTUATOR FOR HIGH-SPEED SWITCH

TECHNICAL FIELD

The present invention relates generally to an actuator for a high-speed switch. More particularly, the present invention relates to an actuator for a high-speed switch, the actuator configured to perform an operation for DC blocking.

BACKGROUND ART

Recently, there have been many studies on high voltage direct current (HVDC), and of interest is a voltage conversion technology which has many advantages in constructing a terminal network compared to current conversion technology which has been widely used. In this regard, unlike other DC blocking methods, high-speed blocking characteristics with low loss are required, and many actuators for a high-speed switch used in DC are being studied.

The document of Korean Patent No. 10-1444729 will be described in the following prior art document. The configuration of the prior art document is disclosed in FIG. 1 of this specification. Here, a high-speed switch 10 and a low-speed switch 20 for opening and closing a line 1 are disclosed.

Herein, the high-speed switch 10 is configured such that a first driving unit 11 includes an upper contact portion 11*a*, a connecting member 11*b* for connecting the upper contact portion 11*a* with a rebound plate 11*c*, and the first driving unit 11 can be moved while the rebound plate 11*c* is pushed by the driving of a first coil driving unit 12 so that the upper contact portion 11*a* is separated from the line 1, whereby the line is opened, and the rebound plate 11*c* is moved by the operation of a spring 13 so that the entire first driving unit 11 is moved, whereby the upper contact portion 11*a* closes the line 1.

However, for the opening operation, the first driving unit 11 must move while overcoming the elastic force of the spring 13. Since the elastic force of the spring 13 is linearly increased as the spring 13 is compressed, the speed of the opening operation becomes slow.

Furthermore, the rebound plate 11*c* is pushed and moved by the restoring force of the spring 13 so that the upper contact portion 11*a* collides with the corresponding electrode to close the line 1. Here, if the restoring force of the spring 13 is large, the shock also becomes large, and damage to the electrode occurs.

DISCLOSURE

Technical Problem

Accordingly, the present invention has been made keeping in mind the above problems occurring in the prior art, and an object of the present invention is to make the opening operation of an actuator for a high-speed switch used in DC faster.

Another object of the present invention is to minimize the shock generated during opening/closing operations in an actuator for a high-speed switch used in DC.

Technical Solution

In order to accomplish the above object, the present invention provides a actuator for a high-speed switch, the actuator including: a frame; a driving unit provided in the frame and provided at an end thereof with a contact brought into contact with an electrode on a line; a first coil unit configured to provide the driving unit with a force in a state where the contact of the driving unit is in contact with the electrode on the line such that the contact is separated from the electrode; an elastic member configured to move the contact of the driving unit to be brought into contact with the electrode on the line and maintain a contact state of the contact with the electrode; and a permanent magnet configured to allow the contact of the driving unit to be brought into contact with the electrode on the line and maintain the contact state, along with the elastic member.

The frame may include: multiple mounting plates: and multiple columns configured to maintain intervals between the mounting plates, wherein the driving unit is movably provided through the mounting plates.

The driving unit may include: a driving shaft provided through the mounting plates and provided with the contact at an end thereof; a first driving plate provided on the driving shaft, and configured to move the driving shaft by the force provided from the first coil unit while facing the first coil unit; and a second driving plate provided on the driving shaft, and configured such that a first surface thereof is supported by the elastic member and a second surface thereof is provided to face the permanent magnet to move the driving shaft.

The permanent magnet may be provided in a core and locked to one of the mounting plates.

The driving shaft may be provided with a hollow portion therein.

A shock absorbing portion may be provided on a mounting plate, to which the elastic member is mounted, to absorb a shock generated during opening operation of the driving unit.

The actuator may further include a latch configured to lock the driving unit while overcoming an elastic force of the elastic member when the driving unit is in an opening state.

Advantageous Effects

According to the present invention having the above-described characteristics, the advantageous effects of the present invention are as follows.

In the present invention, during the opening operation, the force provided by the first coil unit is required to overcome the forces provided by the permanent magnet and elastic member, wherein in the permanent magnet, once the driving unit is separated by a predetermined distance, the force due to the permanent magnet is completely removed and only the force provided by the elastic members needs to be overcome, whereby the opening operation occurs more quickly because the driving unit can be moved more quickly.

Furthermore, in the present invention, when the driving unit performs a closing operation, the driving unit is moved by the force of the permanent magnet and the force of the elastic member and is brought into contact with the electrode on the line, wherein since the maximum forces of the permanent magnet and the elastic member have low value, the shock of the driving unit against the line when operated by the forces is small.

Furthermore, in the present invention, during the opening operation, the second driving plate of the driving unit is out of the magnetic force of the permanent magnet to be applied with a sudden force by the first coil unit, so a shock absorbing portion is provided for reducing the speed of the driving unit, along with the elastic member. Accordingly, the shock absorbing portion causes the operation to be stopped rapidly during the opening operation of the driving unit, and absorbs the shock.

MODE FOR INVENTION

Figure 1:
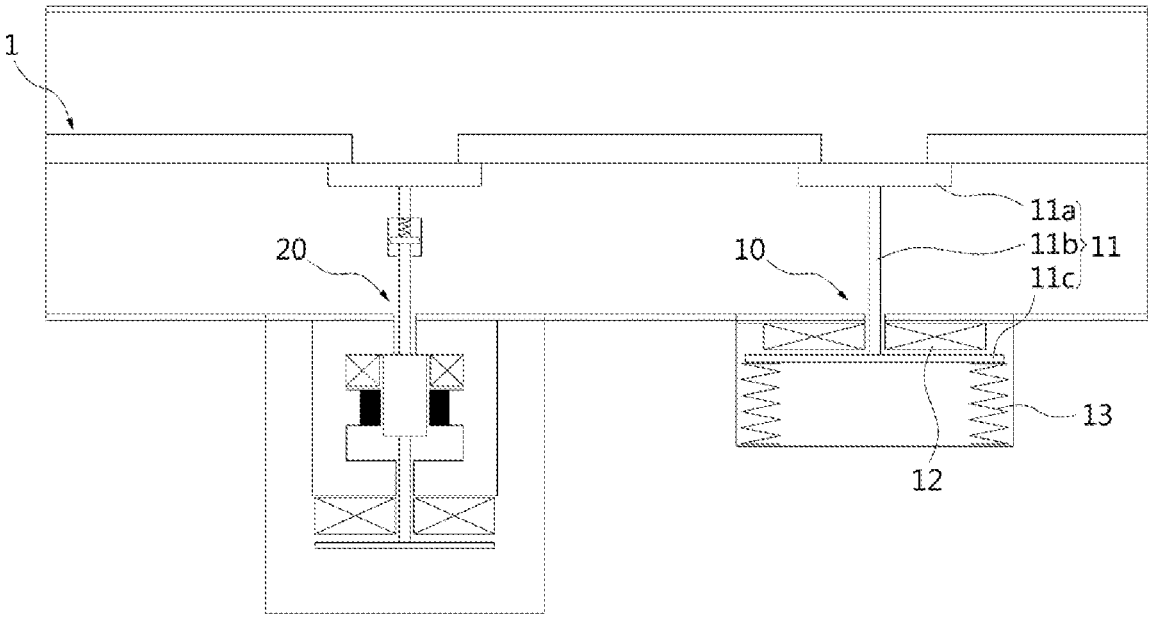
PRIOR ART FIG. 1
FIG. 1 is a schematic diagram showing that an actuator for a high-speed switch according to the prior art is used.
Figure 2:
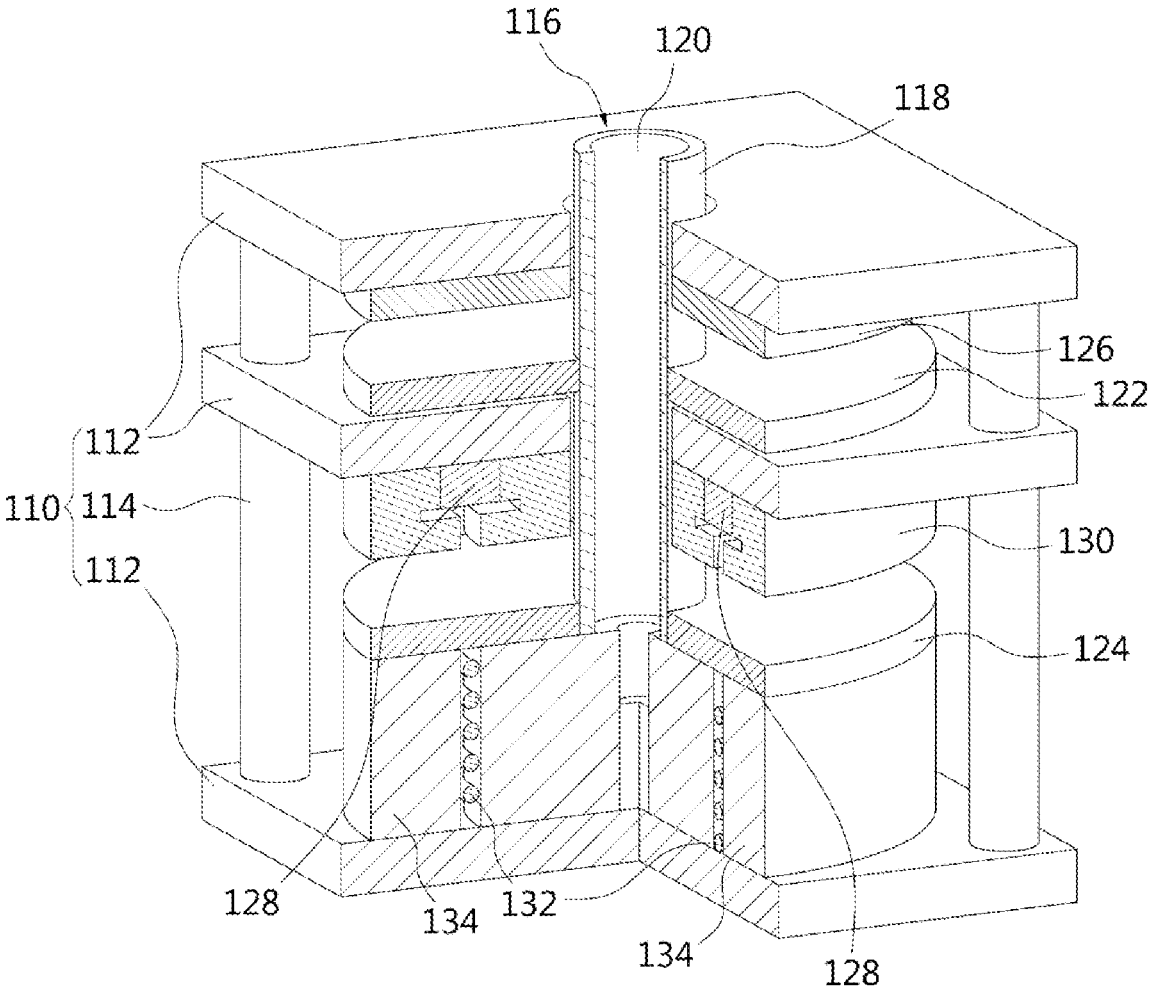
FIG. 2 is a partial sectional perspective view schematically showing a configuration of a preferred embodiment of an actuator for a high-speed switch according to the present invention.
Figure 3:
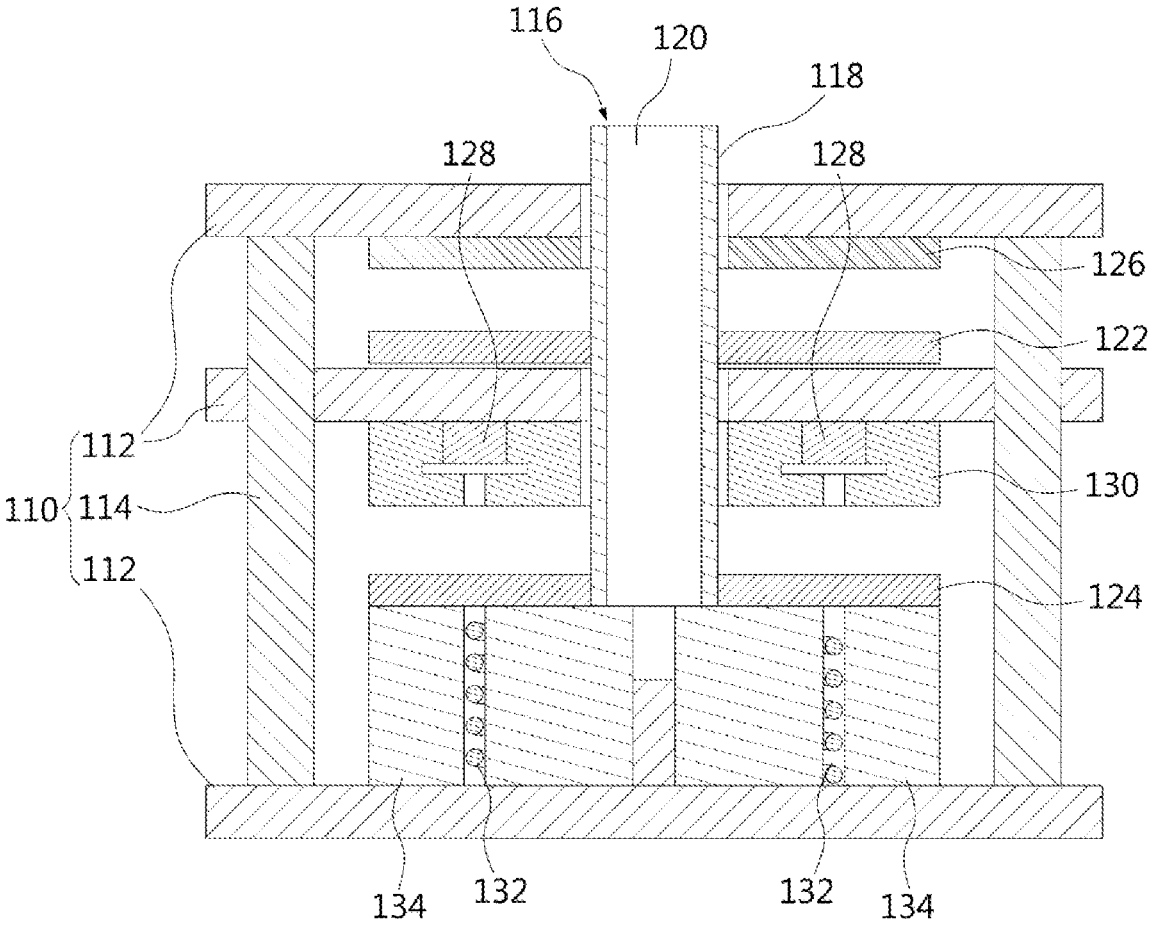
FIG. 3 is a sectional view showing a configuration of an embodiment of the present invention.

Reference will now be made in greater detail to an exemplary embodiment of the present invention, an example of which is illustrated in the accompanying drawings. Wherever possible, the same reference numerals will be used throughout the drawings and the description to refer to the same or like parts. In the following description of the invention, if the related known functions or specific instructions on configuring the gist of the present invention unnecessarily obscure the gist of the invention, the detailed description thereof will be omitted.

Furthermore, it will be understood that, although the terms first, second, A, B, (a), (b), etc. may be used herein to describe various elements, these elements should not be limited by these terms. These terms are only used to distinguish one element, from another element. It will be understood that when an element is referred to as being "coupled" or "connected" to another element, it can be directly coupled or connected to the other element or intervening elements may be present therebetween. In contrast, it should be understood that when an element is referred to as being "directly coupled" or "directly connected" to another element, there are no intervening elements present.

As shown in FIGS. 2 to 5, a frame 110 forms a frame of an actuator for a high-speed switch according to the present invention. In the embodiment, the frame 110 is constituted by multiple mounting plates 112 and columns 114. The mounting plates 112 are parts where the components constituting the present invention are locked and movably supported, and the columns 114 are provided to lock the mounting plates 112 at predetermined intervals. In the present invention, the configuration of the frame 110 may not be limited to a specific one as long as the components constituting the present invention is locked and movable, and may have various configurations other than those shown in the drawings.

In the embodiment, a total of three mounting plates 112 are provided spaced apart from each other at predetermined intervals, the columns 114 maintain the intervals between the mounting plates 112. A driving unit 116 is movably provided through some of the mounting plates 112. The driving unit 116 is moved with respect to the frame 110 by the operation of a first coil unit 126, which will be described below, driven by the operation signal provided from a control unit.

The driving unit 116 includes a driving shaft 118. The driving shaft 118 is in a cylindrical shape having a hollow portion 120 formed therein for quick operation. A first end of the driving shaft 118 is provided with a contact (not shown) coming into contact with an electrode on a line (not shown). In the embodiment, although there is the contact at an upper portion of the driving shaft 118 on the drawing, it is not shown for convenience. The driving shaft 118 is provided through the upper two of the mounting plates 112.

In the driving shaft 118, a first driving plate 122 is provided between the upper two mounting plates 112. The first driving plate 122 is influenced by the magnetic force formed on the first coil unit 126, which will be described below, to generate the movement of the driving unit 116. The first driving plate 122 is made of a metal material.

In the driving shaft 118, at a second end thereof, which is opposite to the first end having the contact, there is a second driving plate 124. The second driving plate 124 is also made of a metal material. An elastic member 132, which will be described below, is brought into contact with the second driving plate 124.

As described above, the first driving plate 122 and the second driving plate 124 are integrally provided on the driving shaft 118, thereby constituting an important part of the driving unit 116. Accordingly, when the driving unit 116 is moved, the driving shaft 118, first driving plate 122, and the second driving plate 124 are integrally moved.

On the first surface of the uppermost mounting plate 112, there is provided the first coil unit 126 to face the first driving plate 122. When the power is applied to the first coil unit 126, a magnetic force is generated so that the first driving plate 122 is attached.

On the lower surface of the middle mounting plate 112, there is provided a permanent magnet 128 to face the first surface of the second driving plate 124. The permanent magnet 128 provides the influence of the magnetic force on the second driving plate 124 to move the second driving plate 124 to the permanent magnet 128 side. The permanent magnet 128 is provided inside a core 130.

On the mounting plate 112 at a location facing the second surface of the second driving plate 124, there is provided the elastic member 132. The elastic member 132 pushes the second driving plate 124 so that the driving unit 116 is in the closed state, that is, in the contact state with the electrode on the line. For reference, in the present invention, the elastic member 132 is not completely restored even when in the closed state. In other words, the elastic member keeps pushing the second driving plate 124. That is, the elastic member maintains the contact force even when the upper contact in contact with the electrode is worn. Here, although the second driving plate 124 is close to the core 130 with the permanent magnet 128, it is not brought into close contact with the same.

Meanwhile, on the mounting plate 112 with the elastic member 132 mounted thereto, there is provided a shock absorbing portion 134. The shock absorbing portion 134 serves to absorb a shock generated at the moment when the driving unit 116 completes the opening operation. When a cylindrical coil spring is used as the elastic member 132, the shock absorbing portion 134 may be provided at a location surrounding the inner space of the elastic member 132 and the exterior of the elastic member 132. The shock absorbing portion 134 may be made of a resilient material.

Furthermore, although not shown in the drawings, to lock the driving unit 116 while overcoming an elastic force of the elastic member 132 in the opening state, a separate latch (not shown) is used. The latch latches the driving shaft 118, thereby locking the driving unit 116 while overcoming an elastic force of the elastic member 132. The latch releases the driving unit 116 during the closing operation by driving the control unit.

Hereinbelow, use of the actuator for a high-speed switch according to present invention configured as described above will be described in detail.

The actuator according to the present invention is in the closed state, that is, in the state where the driving unit 116 connects the line, and when an operation signal in response to the occurrence of the abnormality is provided in the control unit, the actuator is in the opening state. In other words, when an abnormality occurs in the closed state shown in FIG. 5, the line is opened to become the state shown in FIG. 4.

Figure 4:
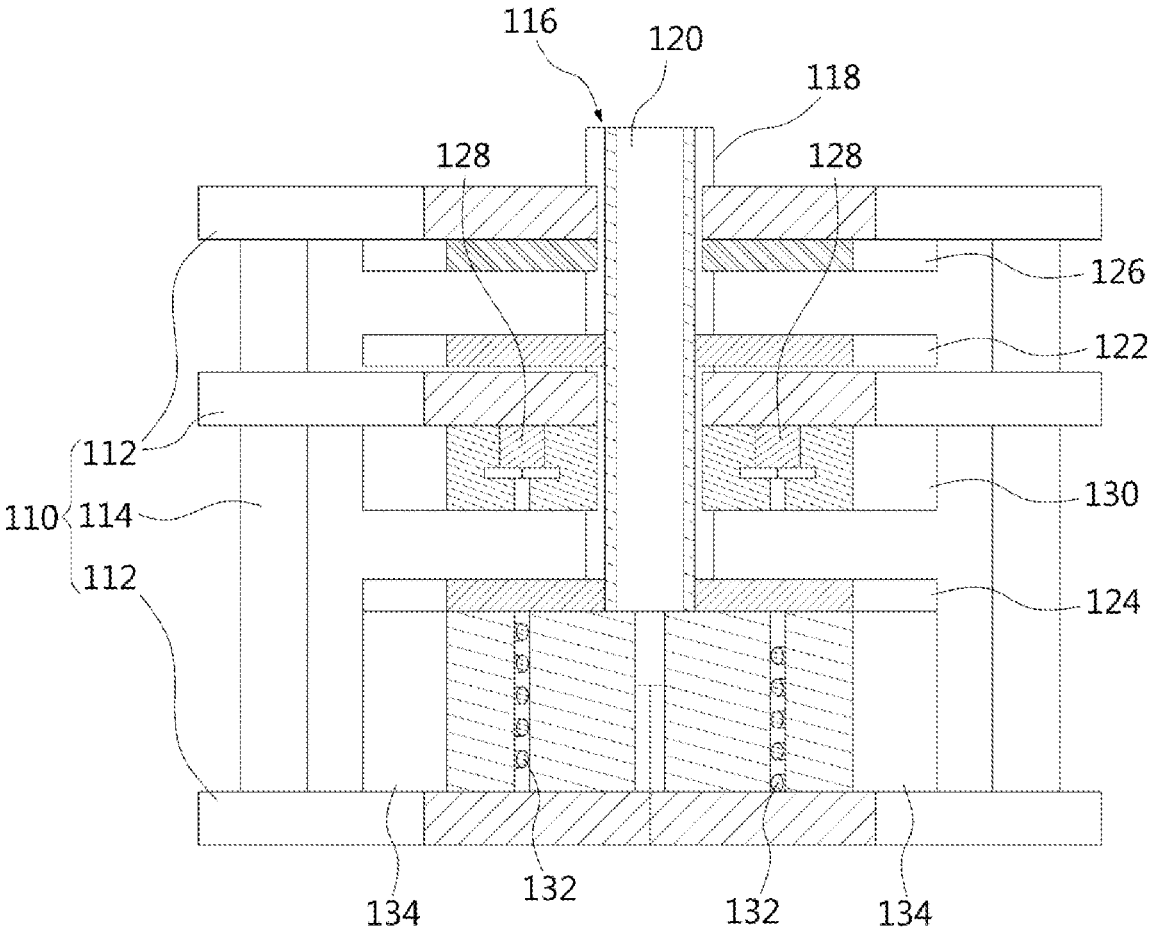
FIG. 4 is an operational state diagram showing that the actuator according to the embodiment of the present invention is in an opening state.

Firstly, in the opening state shown in FIG. 4, the actuator of the present invention is put into the standby state by the release of the latch that locks the driving unit 116. In other words, the resilient force of the elastic member 132 causes the second driving plate 124 to be pushed up, and the second driving plate 124 is brought into close contact with the core 130 while the second driving plate 124 is under the influence of the magnetic force of the permanent magnet 128.

As described above, when the second driving plate 124 is moved by a predetermined distance, the driving shaft 118 is also moved by a corresponding distance, whereby contact provided in the end of the driving shaft 118 is brought into contact with the electrode on the line to connect the line. This state is well shown in FIG. 5.

In this process, the driving unit 116 is moved only by the restoring force of the elastic member 132 and then moved by the magnetic force of the permanent magnet 128. Accordingly, when the restoring force of the elastic member 132 is almost exerted, the magnetic force of the permanent magnet 128 is exerted, so that a large force is not exerted at the end of the operation. In this case, when the driving unit 116 is brought into contact with the contact on the line, a large shock is not generated.

Figure 5:
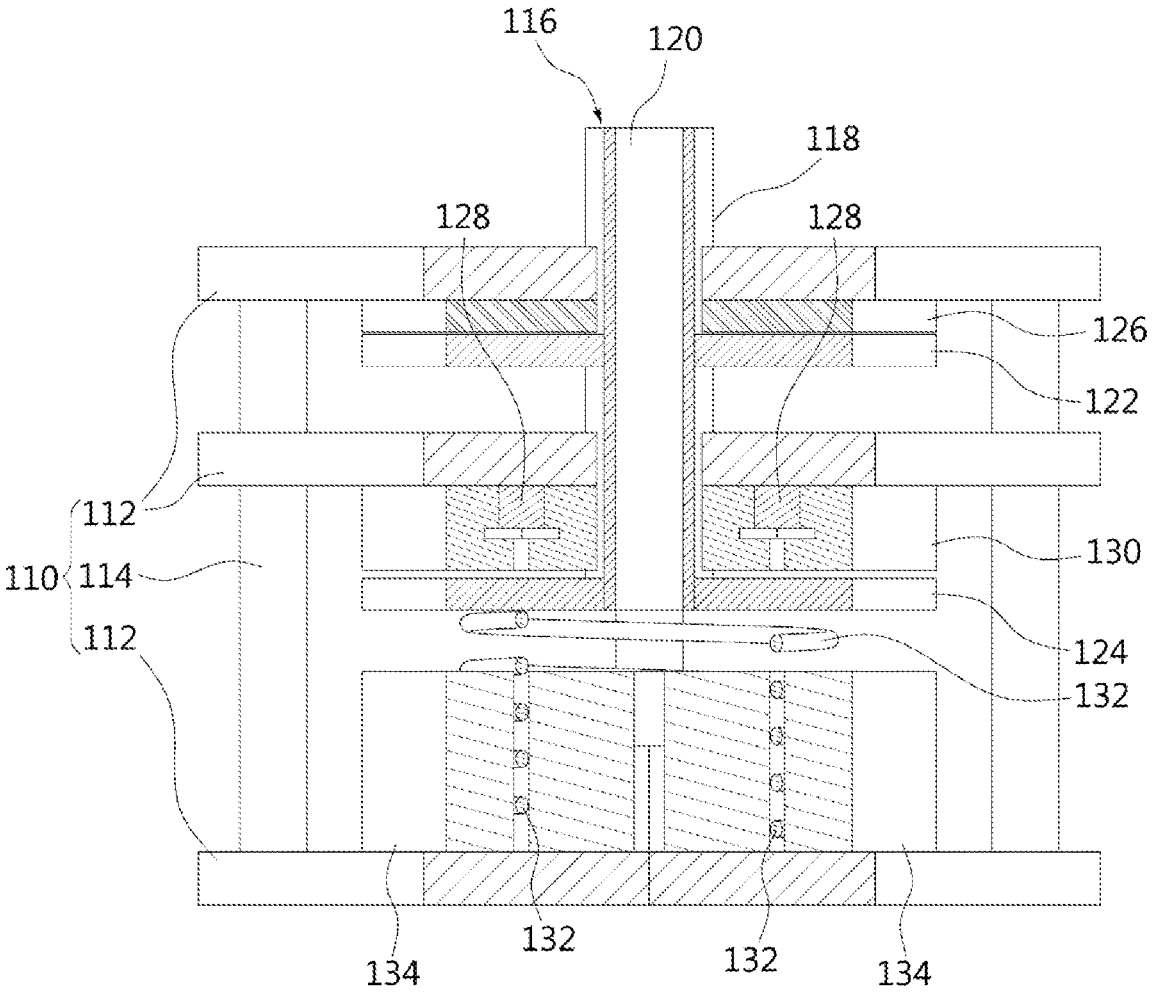
FIG. 5 is an operational state diagram showing that the actuator according to the embodiment of the present invention is in a closed state.

When the operation is performed in the state of FIG. 5, the control unit is operated when an abnormal operation is detected. The control unit allows the first coil unit 126 to be operated. In other words, power is applied to the first coil unit 126 so that the first coil unit 126 generates a magnetic force.

When the magnetic force is generated in the first coil unit 126, the first driving plate 122 is pushed, and the first driving plate 122 is away from the first coil unit 126. When the first driving plate 122 is moved toward the middle mounting plate 112, the entire driving unit 116 is moved and the contact at the end of the driving shaft 118 is separated from the electrode on the line.

The force from the first coil unit 126, which causes the first driving plate 122 to be moved, must be such that it can overcome the forces caused by the elastic member 132 and the permanent magnet 128. However, at first, the force required to overcome the forces caused by the elastic member 132 and the permanent magnet 128 should be provided, once the second driving plate 124 is out of the influence of the permanent magnet 128, the force by the permanent magnet 128 is no longer exerted.

Accordingly, the force to overcome only the force provided by the elastic member 132 is required. Accordingly, once the second driving plate 124 is out of the influence of the permanent magnet 128, all of the force provided by the first coil unit 126 is used to overcome the elastic force of the elastic member 132, thereby moving the driving unit 116 quickly. That is, the opening operation occurs more quickly.

Meanwhile, a shock that may occur as the driving unit 116 is moved over only the restoring force of the elastic member 132 is absorbed by the shock absorbing portion 134. Accordingly, the shock absorbing portion 134 absorbs the shock that the driving unit 116 or the elastic member 132 may get, thereby improving the durability of the actuator.

As described above, when the driving unit 116 is moved forward and the second driving plate 124 elastically deforms the elastic member 132, the latch is driven to lock the driving unit 116. This state is shown in FIG. 4. In order for the driving unit 116 to close the line again, the above-described process is performed again.

Although a preferred embodiment of the present invention has been described for illustrative purposes, those skilled in the art will appreciate that various modifications, additions and substitutions are possible, without departing from the scope and spirit of the invention as disclosed in the accompanying claims. Thus, the embodiment is therefore illustrative and not restrictive, since the scope of the invention is defined by the appended claims rather than by the description preceding them, and all changes that fall within meets and bounds of the claims, or equivalence of such meets and bounds are therefore intended to be embraced by the claims.

The invention claimed is:

1. An actuator for a high-speed switch, the actuator comprising:

a frame;

a driving unit disposed in the frame and provided at an end thereof with a contact brought into contact with an electrode on a line;

a first coil unit configured to provide the driving unit with a force in a state where the contact of the driving unit is in contact with the electrode on the line such that the contact is separated from the electrode;

an elastic member configured to move the contact of the driving unit to be brought into contact with the electrode on the line and maintain a contact state of the contact with the electrode; and a permanent magnet configured to allow the contact of the driving unit to be brought into contact with the electrode on the line and maintain the contact state, along with the elastic member, wherein the frame includes:

multiple mounting plates: and multiple columns configured to maintain intervals between the mounting plates, wherein the driving unit is movably provided through the mounting plates.

2. The actuator of claim 1, wherein the driving unit includes:

a driving shaft provided through the mounting plates and provided with the contact at an end thereof;

a first driving plate provided on the driving shaft, and configured to move the driving shaft by the force provided from the first coil unit while facing the first coil unit; and a second driving plate provided on the driving shaft, and configured such that a first surface thereof is supported by the elastic member and a second surface thereof is provided to face the permanent magnet to move the driving shaft.

3. The actuator of claim 2, wherein the permanent magnet is provided in a core and locked to one of the mounting plates.

4. The actuator of claim 3, wherein the driving shaft is provided with a hollow portion therein.

5. An actuator for a high-speed switch, the actuator comprising:

a frame;

a driving unit disposed in the frame and provided at an end thereof with a contact brought into contact with an electrode on a line;

a first coil unit configured to provide the driving unit with a force in a state where the contact of the driving unit is in contact with the electrode on the line such that the contact is separated from the electrode;

an elastic member configured to move the contact of the driving unit to be brought into contact with the electrode on the line and maintain a contact state of the contact with the electrode; and a permanent magnet configured to allow the contact of the driving unit to be brought into contact with the electrode on the line and maintain the contact state, along with the elastic member, wherein a shock absorbing portion is provided on a mounting plate, to which the elastic member is mounted, to absorb a shock generated during opening operation of the driving unit.

6. The actuator of claim 5, further comprising:

a latch configured to lock the driving unit while overcoming an elastic force of the elastic member when the driving unit is in an opening state.

* * * * *